US009933184B2

(12) United States Patent
Lesage et al.

(10) Patent No.: US 9,933,184 B2
(45) Date of Patent: Apr. 3, 2018

(54) COVER PLATE WITH REMOTELY CONTROLLABLE SWITCHING CIRCUIT

(71) Applicant: MICLAU-S.R.I. INC., Montreal East (CA)

(72) Inventors: Jean-Claude Lesage, Kirkland (CA); Kevin Guay, Terrebonne (CA)

(73) Assignee: MICLAU-S.R.I. INC., Montreal (CA)

( * ) Notice: Subject to any disclaimer, the term of this patent is extended or adjusted under 35 U.S.C. 154(b) by 306 days.

(21) Appl. No.: 14/756,481

(22) Filed: Sep. 10, 2015

(65) Prior Publication Data

US 2017/0074544 A1 Mar. 16, 2017

(51) Int. Cl.

| | |
|---|---|
| ***F24H 1/20*** | (2006.01) |
| ***H05B 3/78*** | (2006.01) |
| ***F24H 1/00*** | (2006.01) |
| ***F24H 1/18*** | (2006.01) |
| ***H05B 1/02*** | (2006.01) |
| ***H05B 3/04*** | (2006.01) |

(52) U.S. Cl.

CPC ..... *F24H 1/0018* (2013.01); *F24H 1/185* (2013.01); *H05B 1/0283* (2013.01); *H05B 3/04* (2013.01)

(58) Field of Classification Search

None

See application file for complete search history.

(56) References Cited

U.S. PATENT DOCUMENTS

| | | | | |
|---|---|---|---|---|
| 3,028,582 | A * | 4/1962 | Carlson | G08C 23/02 116/DIG. 30 |
| 4,317,987 | A * | 3/1982 | Fieldman | F24D 19/1057 219/493 |
| 5,808,277 | A * | 9/1998 | Dosani | F24D 17/0073 219/481 |
| 6,577,817 | B2 * | 6/2003 | Harris | F24H 7/0433 392/479 |
| 6,861,621 | B2 * | 3/2005 | Ghent | F24D 19/1051 219/492 |
| 7,620,302 | B2 * | 11/2009 | Lesage | F24H 1/202 392/454 |
| 8,459,507 | B1 * | 6/2013 | Cascio | F24H 1/08 165/166 |
| 9,151,516 | B2 * | 10/2015 | Buescher | F24H 9/2021 |
| 9,152,160 | B2 * | 10/2015 | Harbin, III | F24D 19/1051 |
| 9,188,363 | B2 * | 11/2015 | Buescher | F24H 9/2021 |
| 9,453,658 | B2 * | 9/2016 | Kreutzman | F24H 1/0018 |
| 2003/0178408 | A1 * | 9/2003 | Ghent | F24D 19/1051 219/492 |

(Continued)

*Primary Examiner* — Thor Campbell

(74) *Attorney, Agent, or Firm* — Guy J. Houle; Houle Patent Agency, Inc.

(57) ABSTRACT

A cover plate for access to the thermostat of an electric water heater associated with a resistive heating element to control the operation thereof is described. The cover plate has mounted on a rear face thereof a remotely controllable switching circuit to control the power being fed to the thermostat and thereby remotely controlling the load. The cover plate with the remotely controllable switching circuit is also provided as a retrofit to convert existing electric water heaters to intelligent remotely controllable water heaters. The remote controller may be a utility, a utility provider or a remote control device. The remote controlled switching circuit is mounted concealed in the access cavity behind the cover plate.

18 Claims, 4 Drawing Sheets

(56) References Cited

U.S. PATENT DOCUMENTS

| | | | | |
|---|---|---|---|---|
| 2010/0004790 | A1* | 1/2010 | Harbin, III | F24D 19/1051 700/291 |
| 2010/0082134 | A1* | 4/2010 | Phillips | F24H 9/2021 700/90 |
| 2013/0200168 | A1* | 8/2013 | Buescher | F24H 9/2021 237/8 A |
| 2015/0276267 | A1* | 10/2015 | Phillips | F24H 9/2014 236/20 R |
| 2016/0146505 | A1* | 5/2016 | Hill | F24H 9/2021 392/498 |
| 2016/0178239 | A1* | 6/2016 | Thornton | F24H 9/2014 700/295 |
| 2017/0059206 | A1* | 3/2017 | Lesage | F24H 9/2007 |
| 2017/0234562 | A1* | 8/2017 | Ribbich | F24F 11/0012 700/277 |

* cited by examiner

COVER PLATE WITH REMOTELY CONTROLLABLE SWITCHING CIRCUIT

TECHNICAL FIELD

The present invention relates to a cover plate for access to the thermostat of an electric water heater and more particularly to a cover plate equipped with a remotely controllable switching circuit to control the operation of the electric resistive heating element associated with the thermostat. The cover plate with the switching circuit is further utilized as a retrofit to convert an existing water heater to an intelligent water heater.

BACKGROUND OF THE INVENTION

Electrical water heaters of the domestic type comprise a tank in which is mounted two or sometimes three resistive heating elements disposed at different levels to heat water. The resistive heating elements are controlled by respective thermostats which have set point temperature values whereby to control the temperature of the water inside the tank at different levels. The thermostats have a control portion and a switching portion to switch the resistive heating elements on and off by allowing and cutting the power supply thereto depending on the temperature of the water in relation to the set point temperature of the thermostats. The power supply wiring is usually through a control box mounted on top of the water heater or through a port in the outer wall of the casing with the wiring extending along the tank wall to the thermostats. The wiring is usually held in place by the foam insulation which is injected between the tank and the outer casing mounted spaced about the tank. Foam dams prevent the injected insulating foam material from propagating into the space surrounding the thermostats and the resistive heating elements whereby to form an access space for servicing and adjustment of the set point temperature of the thermostat. The thermostat is provided with several terminals and the power supply wires are connected to specific ones of these. An access door is removably secured to the outer casing for access to each thermostat and resistive heating element.

With the advent of more intelligent water heaters it is necessary to mount electronic devices on such water heaters during fabrication and install associated wiring to control the operation of the electric water heater. Although these electronic devices are mounted in housings it is necessary to provide access thereto for trouble shooting and repair. Accordingly, because these housings are exteriorly mounted they are exposed to environmental conditions, such as dust, humidity, water infiltration and are succeptable to physical damage during installation of the water heater. They are also unsightly and occupy space.

Because intelligent water heaters are progressing quickly, new control devices are continuously being developed by various manufacturers, suppliers and utility providers and the benefit of such more intelligent water heaters can more easily be obtained by the purchasing of a new water heater. Accordingly, existing water heaters cannot benefit from this new technology unless these are modified on site to adapt new control devices thereto. Such modifications are very costly to the consumer or the utility and most will not bear such cost although there is a saving to them by consuming less electricity. Also, depending on the physical location of the water heater the adaption of new control hardware and wiring is often left to the installer to decide how it will be mounted and sometimes resulting in wiring exposed outside the water heating unit and controls being mounted on the outer casing at various locations and sometimes on an adjacent wall of the building structure.

SUMMARY OF THE INVENTION

It is desirable to overcome the above mentioned disadvantages of the prior art electric water heaters.

It is therefore a feature of the present invention to provide a novel way of mounting a switching circuit and control which is remotely controlled to switch the resistive heating elements on and off.

It is further feature of the present invention to provide a cover plate for access to the thermostat and resistive heating element and wherein the cover plate is equipped with a remotely controllable switching circuit to control the operation of the electric resistive heating element.

It is a further feature of the present invention to provide a cover plate for access to the thermostat associated with a resistive heating element and wherein the cover plate has mounted, on an inner face thereof, a remotely controllable switching circuit provided with connection means for easy installation to the power supply wiring of the thermostat.

A further feature of the present invention is to provide a thermostat cover plate equipped with a remotely controllable switching circuit and which once installed is not visible to the eye as it is integrally mounted inside the access space to the thermostat and associated resistive heating element.

A still further feature of the present invention is to provide a thermostat cover plate provided with a remotely controllable switching circuit to retrofit an existing electric water heater to convert same to an intelligent water heater by being remotely controlled to regulate the consumption of electrical power.

Another feature of the present invention is to provide an inexpensive means for a utility or utility providers to convert existing electric water heaters to remotely controllable water heaters and wherein certification is not affected while providing them with a means to regulate power consumption and particularly in power failure situations or peak load sheading.

Another feature of the present invention is to provide the consumer of an inexpensive way to convert its existing electric water heater to an intelligent water heater to manage the operation of the water heater to thereby consume less electricity during a given time periods and wherein the installation thereof is foolproof and easy.

According to the above mentioned features, from a broad aspect, the present invention provides a removable cover plate secured to an outer jacket of an electric water heater for access to a thermostat connected to a resistive heating element of an electric water heater. The cover plated has an outer surface and an inner surface and wherein there is mounted on the inner surface switching circuit means having input electrical connection means for connection to power leads and output electrical connections for providing electrical connection to selected terminals to the thermostat. The switching circuit means has a control circuit for operating a switch interconnecting the power leads connected to the input electrical connection means to the output electrical connection means. The control circuit is operatively controlled by a remote controller to remotely control the operation of the switch to connect and disconnect power from the power leads to the selected terminals of the thermostat.

According to a further broad aspect of the present invention there is provided a retrofit cover plate for the replacement of an existing cover plate of an electric water heater for access to a thermostat connected to a resistive heating element of the electric water heater. The cover plate has an outer surface and an inner surface and wherein there is mounted on the inner surface switching circuit means. The switching circuit means has input electrical connection means for connection to power leads disconnected from selected terminals of the thermostat. Output electrical connections means provide electrical connection to the selected terminals. The switching circuit means has a control circuit for operating a switch interconnecting the power leads connected to the input electrical connection means to the output electrical connection means. The control circuit is operatively controlled by a remote controller to remotely control the operation of the switch to connect and disconnect the power from the power leads to the output connection means and thereby control the operation of the resistive heating element by connecting and disconnecting the power leads from the selected terminals of the thermostat.

DESCRIPTION OF THE DRAWINGS

A preferred embodiment of the present invention will now be described with reference to the accompanying drawings in which.

DETAILED DESCRIPTION

Figure 1:
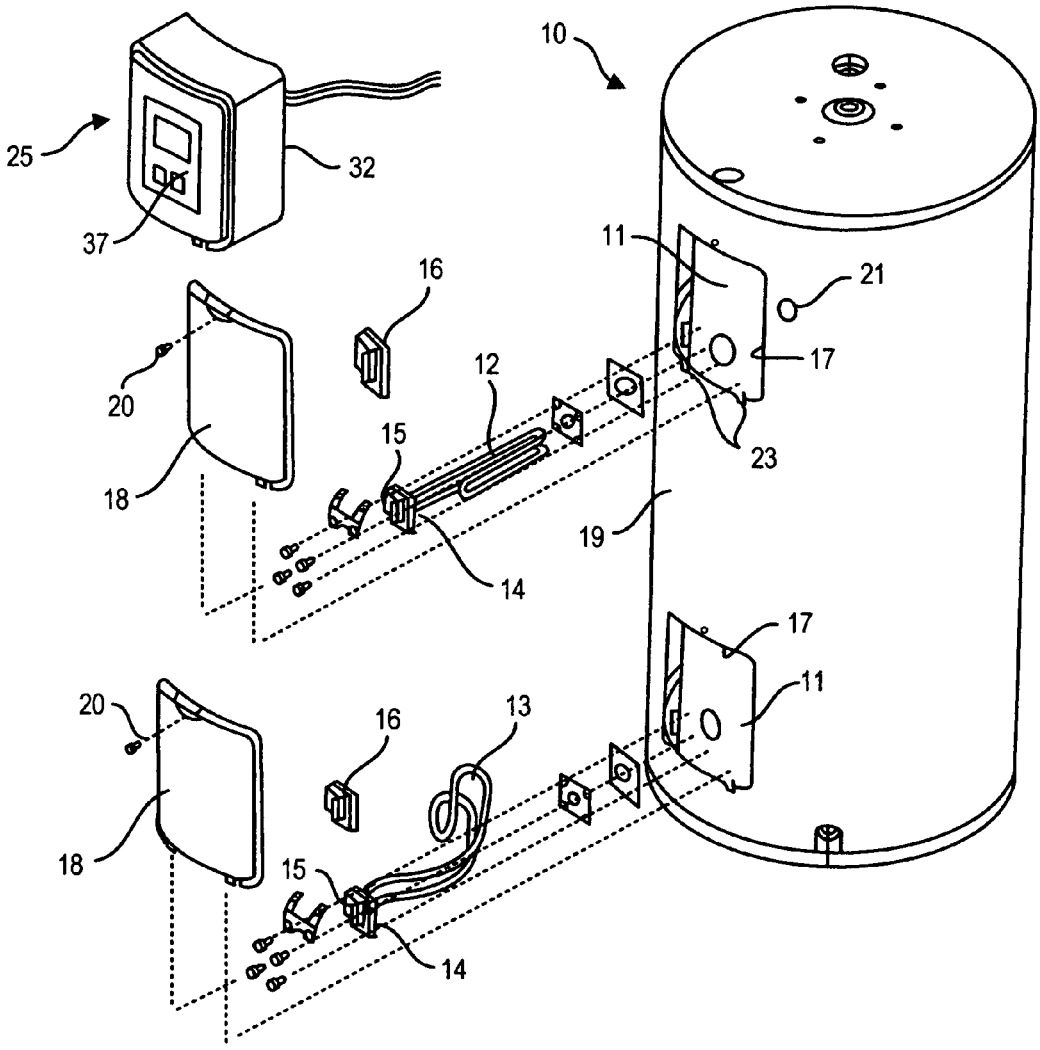
FIG. 1 is a partly exploded view of a two element electric water heater showing the component parts of the resistive heating elements and associated thermostat and cover plate illustrating the retrofit cover plate of the present invention provided with a remotely controllable switching circuit mounted on the back face of the retrofit cover plate.

Referring now to the drawings and more particularly to FIG. 1, there is shown generally at 10 a two element electric water heater which is provided with a inner casing 11, herein a steel tank, in which there is contained water to be heated by two resistive heating elements herein a top resistive heating element 12 and a bottom resistive heating element 13 having the same power ratings. Each resistive heating element has a mounting plate 14 provided with terminals 15 to which is connected wires from an associated thermostat 16 to receive power when the temperature of the water in the tank in the area of the resistive heating elements falls below a set point temperature as set in the associated thermostat 16. A power supply entrance hole 21 is provided in the outer casing 19 adjacent one of the openings 17, or surrounding open area of the thermostat and resistive heating element, and is covered by a cover plate 18 removably attached to the outer casing 19 by suitable fastening means such as a screw 20. As herein illustrated, the top cover plate 18 is to be replaced by a modified retrofit cover plate 25 of the present invention.

Figure 2:
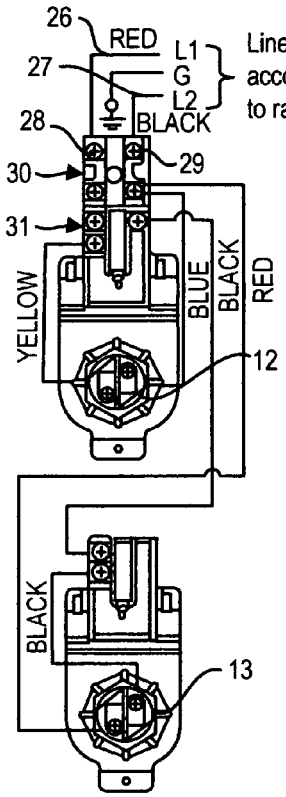
(PRIOR ART) FIG. 2
FIG. 2 is a conventional wiring diagram of a thermostat and its associated resistive heating element.

FIG. 2 illustrates the conventional wiring between the thermostat 15 and the top resistive heating element 12 and the interconnection between both resistive heating elements 12 and 13. Power leads 26 and 27 are connected to power terminals 28 and 29 of the control portion 30 of the thermostat. The switching portion 31 contains a switch, not shown but obvious to a person skilled in the art, which is operated by the control portion depending on the temperature of the water inside the casing 11. Of course, the bottom resistive heating element 13 may be wired differently wherein a separate power cable may run from a control box usually mounted on top of the water heater, or from a power block conveniently mounted inside the tank next to the top thermostat.

Figure 7:
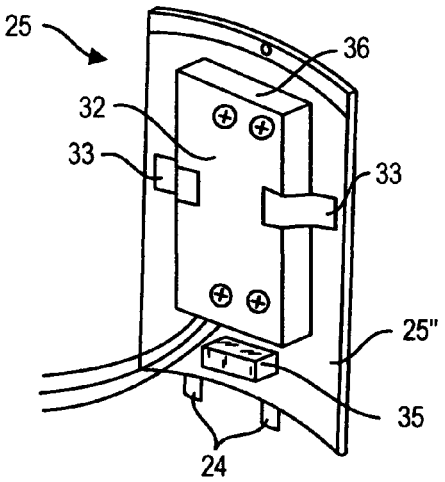
FIG. 7 is a perspective rear view of the cover plate showing a removably mounted switching circuit.
Figure 8:
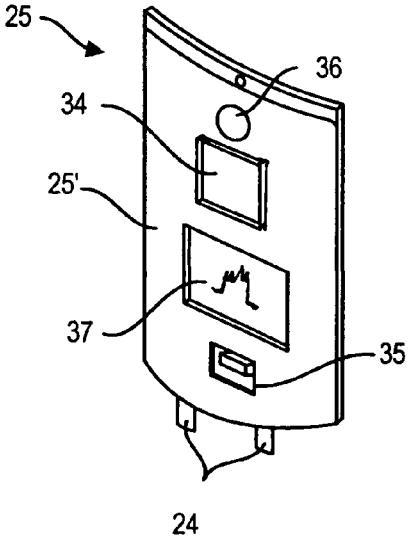
FIG. 8 is a perspective front view of the cover plate showing various modifications thereto.

With reference now to the additional Figures, there is described the present invention of the modified cover plate 25. As shown in FIGS. 7 and 8, the cover plate 25 is fabricated from non-electrically conductive material such as plastic, fibreglass, etc. to permit wireless communication with the control circuit. The cover plate has an outer surface 25' and an inner surface 25". The inner surface 25" is provided witch a switching circuit means mounted in a housing 32 secured thereto. The housing 32 could also be detachably mounted by clamps 33 for ease of replacement. On the outer surface 25' there is herein illustrated an antenna module 34 mounted thereon or moulded therein. In the case where the cover plate is a metal plate, then the antenna would be exteriorly mounted on the cover plate or on top of the water heater with the wiring disposed between the tank 11 and the outer casing 19 in a tube (not shown) disposed in place before injection to the foam insulation. A USB port 35 provides for connection to the circuitry of the switching circuit or other circuitry to extract information or download information in associated circuits. A pilot lamp 36 may also be provided to indicate that the resistive heating element is active or dormant. An LED screen 37 may also be mounted on the front face 25' to provide various information associated with the switching circuit and its controls. As illustrated, the bottom edge of the cover plate 25 is provided with legs 24 which are shaped to be retained captive behind notches 23 cut in the lower edge of the opening 17. Alternatively, the bottom edge of the cover plate 25 could be fitted with a hinge to hingedly attach the cover plate adjacent the lower edge of the opening 17. Still further, the cover plate 25 could have a tether lead or wire connected thereto for attachment to the outer casing 19 whereby the retrofit cover plate is attached to the outer casing of the water heater for security purposes.

Figure 3:
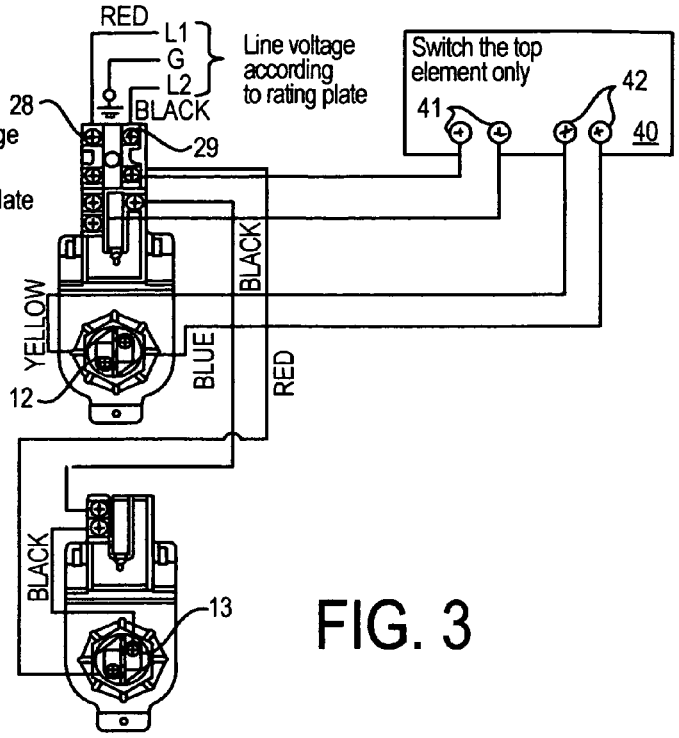
FIG. 3 is a wiring diagram similar to FIG. 1, but illustrating the switching circuit of the cover plate connected to the thermostat of a top element of a two element electric water heater.
Figure 4:
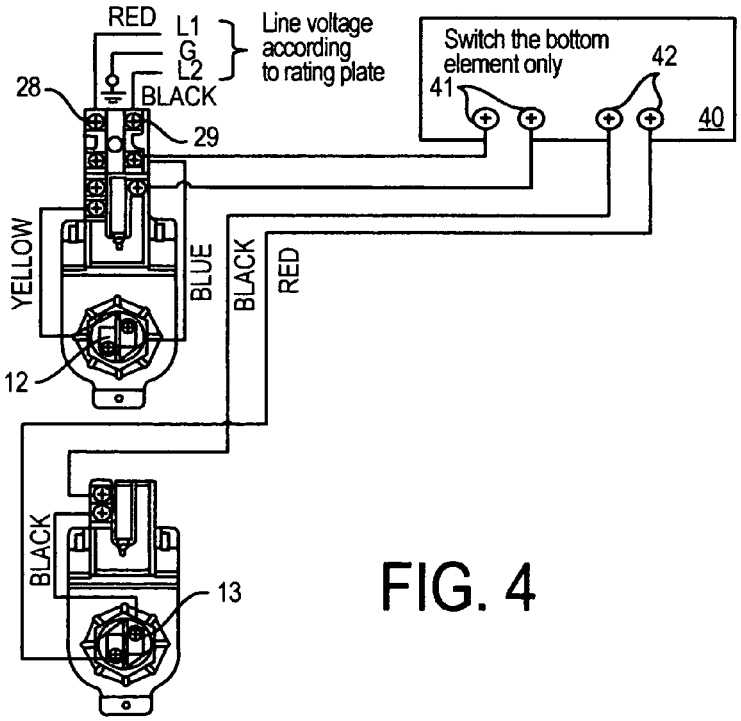
FIG. 4 is a wiring diagram similar to FIG. 3, but illustrating the switching circuit of the cover plate connected to the bottom thermostat of a two element electric water heater or the middle element of a three element electric water heater.
Figure 5:
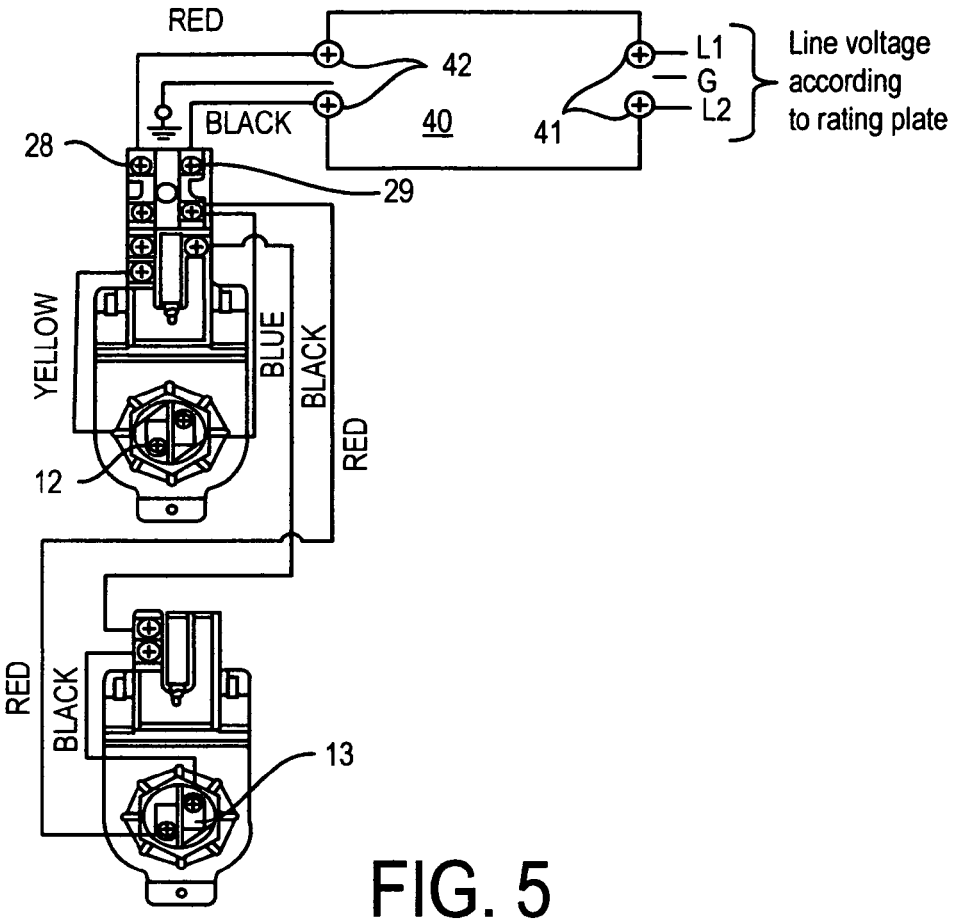
FIG. 5 is a wiring diagram similar to FIG. 3, but illustrating the switching circuit of the cover plate connected to the top resistive heating element which is connected in series with the bottom resistive heating element for controlling the power provided to both elements.

With reference to FIGS. 3 to 5, there is illustrated various wiring arrangement for controlling the operation of the top or bottom resistive heating element 12 and 13. In a three element electric water heater the bottom element 13 can be considered as a middle element and the third bottom element could also be fitted with the cover plate of the present invention with its control circuit to also control the operation of the bottom resistive heating element. The switching circuit means is generally indicated by reference numeral 40 and may consist of different types of switching arrangements and associated circuitry, a few of which are generally depicted by FIGS. 6A and 6B, which illustrates an electronic switch and electro-mechanical switch, respectively.

As shown in FIG. 3, the switching circuit 40 is provided input electrical connection means in the form of terminals 41 for receiving power leads directly from the power cable entering hole 21 in the outer casing of the water heater or power leads disconnected from the power terminals 28 and 29 of the control portion 30 of the thermostat 16. The switching circuit 40 also has output electrical connection means in the form of terminals 42 for providing electrical connection through wires to selected terminals of a selected one of the thermostat depending if it is controlling to top or bottom resistive heating element or both simultaneously. The selected terminals are from the control portion 30 and the switching portion 31 of the thermostat depending on which of the two resistive heating elements is being controlled. In FIG. 3 the wiring is for control of the top electrical resistive heating element 12 only, whereas in FIG. 4 the wiring illustrates the connection for operating the bottom resistive heating element only. FIG. 5 shows the 220 volts entrance power cable connected directly to the input terminals 41 of the switching circuit 40 and the output terminals 42 are connected to the power terminals 28 and 29 of the thermostat control portion of the top resistive heating element 12. Of course, instead of screw terminals 41 and 42 these may be constituted by leads to which the connection are made when considering that the switching circuit could be encapsulated in electrically insulating molded material.

Figure 6A:
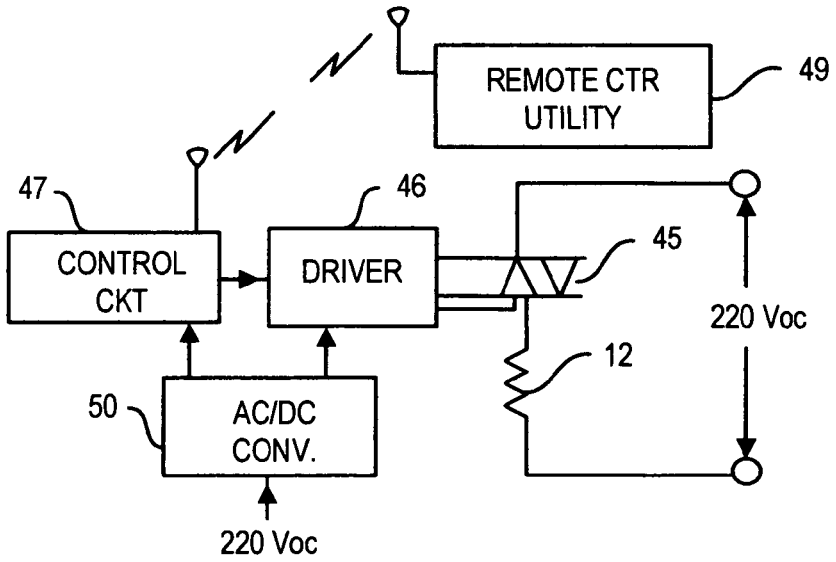
FIG. 6A is a simplified electrical block diagram of a remotely controllable electronic switch.

FIG. 6A is a simplified block diagram of an electronic switch, herein in the form of a triac 45, operated by a driver circuit 46 which is placed into operation by a control circuit 47. An AC/DC converter circuit 50 provides the necessary 24 vdc to the circuitry of the control circuit 47 and the driver circuit 46. The control circuit 47 is remotely controlled, in a wireless manner, by signals received from its antenna 48 from a satellite and emanating from a utility 49 or utility provider. The control circuit 47 may also be controlled by wired connection from an Ethernet network topography or an Internet connectivity or any other communication circuit arrangement obvious to a person skilled in the art.

Figure 6B:
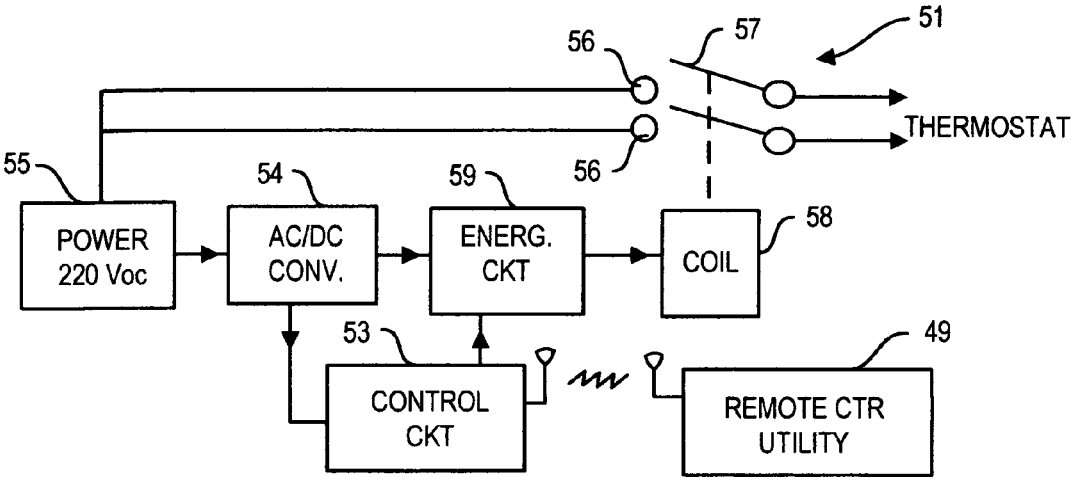
FIG. 6B is a block diagram of an electro-mechanical remotely controllable switch.

FIG. 6B is a further simplified block diagram of an electro-mechanical switch, herein a relay switch 51 having an energizing circuit 52 controlled by a controller circuit 53. An AC/DC converter 54 provides the necessary 24 vdc to the circuits. The 220 vac is connected to the terminal 56 of the switch arm 57 which is operated by energizing its coil 58. The coil 58 is energized by its energizing circuit connection 59 controlled by the control circuit 53 which is itself remotely controlled by the utility or utility provider 49 or other remote controller device.

It is within the ambit of the present invention to cover any obvious modifications of the embodiments described herein provided such modifications fall within the scope of the appended claims.

The invention claimed is:

1. A cover plate removably secured to a vertical side wall of an outer jacket of a domestic electric water heater for direct access to a thermostat connected to a selected one of at least two resistive heating elements secured to an inner casing of said electric water heater with the resistive heating elements secured spaced apart to said inner casing of said electrical water heater and electrically interconnected together, said inner casing being pressurized by a domestic water supply connected thereto, said cover plate having an outer surface and an inner surface and wherein there is mounted on said inner surface switching circuit means, said switching circuit means having input electrical connection means for connection to power leads disconnected from selected terminals of said thermostat of said selected one of said at least two resistive heating elements, and output electrical connection means for providing electrical connection to said selected terminals of said thermostat, said switching circuit means having a control circuit for operating a switch interconnecting said power leads connected to said input electrical connection means to said output electrical connection means, said control circuit means having an antenna connected thereto for receiving wireless control signals for being operatively controlled by a remote controller to remotely control the operation of said switch to connect and disconnect power from said power leads to said selected terminals of said thermostat.

2. The cover plate as claimed in claim 1 wherein said selected terminals are power terminals of a control portion and a switching portion of said thermostat, said selected terminals providing for the control of power to one of a top or bottom one of said at least two resistive heating elements.

3. The cover plate as claimed in claim 1 wherein said selected terminals are power terminals of a control portion and a switching portion of said thermostat, said selected terminals providing for the control of power to one of a top, middle and bottom one of a three element water heater, or a combination of said top, middle and bottom resistive heating elements.

4. The cover plate as claimed in claim 1 wherein said cover plate is constructed of a non-electrically conductive material.

5. The cover plate as claimed in claim 1 wherein said switch is comprised of an electronic switch operatively connected to said control circuit operated by said remote controller.

6. The cover plate as claimed in claim 1 wherein said switching means is comprised of an electro-mechanical switch having switching contacts engageable by switch arms, said switch arms being activated by a coil energized by an energizing circuit controlled by a control circuit, said control circuit being controlled by a remote controller.

7. The cover plate as claimed in claim 1 wherein said antenna is mounted in said outer surface of said cover plate.

8. The cover plate as claimed in claim 1 wherein a USB port and/or Ethernet or other suitable connector is mounted in or on said cover plate to provide external connection to said control circuit to download or extract information therefrom.

9. The cover plate as claimed in claim 7 wherein said cover plate is a metal cover plate.

10. The cover plate as claimed in claim 1 input electrical connection means are input electrical connecting terminals for attaching said power leads thereto.

11. The cover plate as claimed in claim 1 wherein said output electrical connection means is one of output electrical connecting terminals and output leads.

12. A retrofit cover plate for the replacement of an existing cover plate of an electrical water heater for access to a thermostat connected to a resistive heating element of said electric water heater, said cover plate having an outer surface and an inner surface and wherein there is mounted on said inner surface switching circuit means, said switching circuit means having input electrical connection means for connection to power leads disconnected from selected terminals of said thermostat, and output electrical connection means for providing electrical connection to said selected terminals, said switching circuit means having a control circuit for operating a switch interconnecting said power leads connected to said input electrical connection means to said output connection means, said control circuit being operatively controlled by a remote controller to remotely control the operation of said switch to connect and disconnect said power leads to said output connection means and thereby control the operation of said resistive heating element by connecting and disconnecting said power leads from said selected terminals of said thermostat.

13. The retrofit cover plate as claimed in claim 12 wherein said selected terminals are power terminals of a control portion and a switching portion of said thermostat, said selected terminals providing for the control of power to one of a top or bottom resistive heating element of a two element water heater.

14. The retrofit cover plate as claimed in claim 12 wherein said selected terminals are power terminals of a control portion and a switching portion of said thermostat, said selected terminals providing for the control of power to one of a top, middle and bottom resistive heating element of a three element water heater, or a combination of said top, middle and bottom resistive heating elements.

15. The retrofit cover plate as claimed in claim 12 wherein said cover plate is constructed of a non-electrically conductive material.

16. The retrofit cover plate as claimed in claim 12 wherein there is further provided an antenna connected to said control circuit to receive wireless control signals from said remote controller, and wherein a USB port and/or Ethernet or other suitable connector is mounted in said cover plate to provide external connection to said control circuit to download or extract information therefrom.

17. The retrofit cover plate as claimed in claim 12 wherein said switching circuit means is mounted in a housing, said housing being removably attached to said inner surface of said cover plate.

18. The retrofit cover plate as claimed in claim 12 wherein said output electrical connection means comprises a set of leads for connection to said power terminals of said thermostat to which said power leads of said power supply have been disconnected.

* * * * *